US005136140A

United States Patent [19]

Theurer et al.

[11] Patent Number: 5,136,140

[45] Date of Patent: Aug. 4, 1992

[54] RAIL TENSIONING APPARATUS

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 689,354

[22] Filed: Apr. 22, 1991

[30] Foreign Application Priority Data

May 2, 1990 [AT] Austria ..... 999/90

[51] Int. Cl.[5] ..... B23K 11/02

[52] U.S. Cl. ..... 219/161; 219/53; 219/55

[58] Field of Search ..... 219/101, 103, 104, 161, 219/53, 55; 104/15

[56] References Cited

U.S. PATENT DOCUMENTS 4,103,139 7/1978 Zollinger ..... 219/161
4,215,260 7/1980 Zollinger ..... 219/53
4,270,036 5/1981 Zollinger ..... 219/53
4,983,801 1/1991 Theurer et al. .

FOREIGN PATENT DOCUMENTS 0016664 1/1983 European Pat. Off. .
0132227 1/1985 European Pat. Off. .
0253634 1/1988 European Pat. Off. .
2830006 1/1979 Fed. Rep. of Germany .
1294216 10/1972 United Kingdom .

*Primary Examiner*—Clifford C. Shaw
*Attorney, Agent, or Firm*—Collard & Roe

[57] ABSTRACT

An apparatus for reducing a gap between an end of a rail section and an adjacent end of a longitudinally succeeding rail section of a rail fastened to ties by fastening elements by tensioning or longitudinally extending the rail section comprises two longitudinally spaced beams extending transversely to the track rails, a pair of clamping members mounted on each transverse beam for pivoting about parallel vertical axes at respective sides of the rail sections of the rail and having cooperating clamping jaws for engaging the rail sections between the clamping members upon pivoting thereof, the pairs of clamping members being longitudinally spaced from each other, hydraulic drives interconnecting the clamping members at each side of the rail sections of the rail, and a rail centering mechanism affixed to each transverse beam in the range of each pair of clamping members, each rail centering mechanism comprising at least two independently operable hydraulic cylinders carrying rams adapted to be pressed against at least one of said track components of the rail upon operation of the hydraulic cylinders.

12 Claims, 2 Drawing Sheets

RAIL TENSIONING APPARATUS

BACKGROUND OF THE INVENTION

1. Field of the Invention

The present invention relates to an apparatus for changing the width of a gap between an end of a rail section and an adjacent end of a longitudinally succeeding rail section of a rail fastened to ties by fastening elements, two of the rails and the ties constituting components of a track and each rail section comprising a vertically extending web and a rail head, the gap being reduced by tensioning or longitudinally extending the rail section after the fastening elements fastening the rail section to the ties have been loosened. The apparatus comprises two longitudinally spaced beams extending transversely to the track rails, a pair of clamping members mounted on each transverse beam for pivoting about parallel vertical axes at respective sides of the rail sections of the rail and having cooperating clamping jaws for engaging the rail sections between the clamping members upon pivoting thereof, the pairs of clamping members being longitudinally spaced from each other, and hydraulic drives interconnecting the clamping members at each side of the rail sections of the rail.

2. Description of the Prior Art

British patent No. 1,294,216, published Oct. 25, 1972, discloses a ring-shaped structural rail tensioning unit of this general type and comprising two longitudinally spaced clamping heads interconnected by tie members extending above and below the rail for rotation about vertical axes. The clamping heads have clamping jaws for engagement with the rail web and are connected by short bell-crank levers to hydraulic drives and tensioning members extending in the direction of the rail. When the two hydraulic drives are operated by a manually actuated hydraulic fluid pump, the clamping heads are pivoted towards the rail and the clamping jaws are pressed against the rail web. Subsequently, the two adjacent rail section ends are longitudinally extended towards each other to reduce the gap therebetween to the desired distance However, the two rail section ends cannot be centered with respect to each other.

European patent application No. 132,227, published Jan. 23, 1985, discloses a mechanism for the alignment of two adjacent rail section ends and flash butt-welding the aligned rail section ends. The mechanism comprises a rigid frame comprised of two elongated beams extending parallel to the rail and four cross beams rigidly interconnecting the elongated beams. Casings are arranged at the longitudinal ends of the frame below and above the frame and the casings are displaceable towards each other by hydraulic drives. Tensioning tongs comprising two clamping jaws are arranged at each end of the mechanism and a transversely extending cylinder actuates the clamping jaws for engagement with the interposed rail web. This mechanism is costly and complex, due to the rigid frame and the numerous hydraulic drives.

Another rail tensioning mechanism including clamping heads interconnected by hydraulic drives has been disclosed in European patent application No. 253,634, published Jan. 20, 1988. Other hydraulically operated rail tensioning devices for reducing the gap between adjacent rail section ends are disclosed in European patent No. 16,664, published Jan. 19, 1983, and German patent application No. 2,830,006, published Jan. 25, 1979.

U.S. Pat. No. 4,938,801, dated Jan. 8, 1991, describes another rail tensioning apparatus of the first-described type, wherein the two pairs of clamping members are so spaced longitudinally that the resultant ring-shaped rail tensioning mechanism including the interconnecting hydraulic drives provides sufficient space to accommodate a flash butt-welding head. In this manner, even relatively heavy rail sections with substantial gaps between adjacent ends thereof may be pulled together for flash butt-welding.

SUMMARY OF THE INVENTION

It is the primary object of this invention to provide a rail tensioning apparatus of the indicated type which is capable of applying high tensile or pushing forces to a rail section for longitudinally extending or retracting the same while, at the same time, readily centering two adjacent ends of rail sections with respect to each other for use in conjunction with a flash butt-welding head operated to weld the two rail section ends together.

In an apparatus comprising two longitudinally spaced beams extending transversely to the track rails, a pair of clamping members mounted on each transverse beam for pivoting about parallel vertical axes at respective sides of the rail sections of the rail and having cooperating clamping jaws for engaging the rail sections between the clamping members upon pivoting thereof, the pairs of clamping members being longitudinally spaced from each other, and hydraulic drives interconnecting the clamping members at each side of the rail sections of the rail, the above and other objects are accomplished according to the invention with a rail centering mechanism affixed to each transverse beam in the range of each pair of clamping members, each rail centering mechanism comprising at least two independently operable hydraulic cylinders carrying rams adapted to be pressed against the rail section and/or the ties of the rail upon operation of the hydraulic cylinders.

With such an apparatus, it is possible to change the width of the gap between adjacent ends of rail sections problem-free and under the application of very high tensile or pushing forces while the rail section ends will be centered appropriately for immediate flash butt-welding. Since the rams of the hydraulic cylinders of the rail centering mechanism are pressed directly against the rail section ends and/or ties, the structure of the centering mechanism is quite simple. In addition, since the centering mechanism is connected to the transverse beam of the tensioning mechanism, no rigid frame, which considerably interferes with the positioning of the welding head, is required for connecting the two mechanisms.

The hydraulic drives extend substantially parallel to the rail and a vertical plane of symmetry extends through the rail between the sides thereof, and the rail centering mechanism preferably comprises two hydraulic cylinders extending horizontally and perpendicularly to the rail at opposite sides of the plane of symmetry, and two additional hydraulic cylinders extending parallel to the vertical pivoting axes of the clamping members. Such four hydraulic cylinders provide a very simple structure for accurately transversely and vertically centering the rail section ends.

According to a preferred feature of the present invention, the additional hydraulic cylinders have downwardly projecting vertical piston rods having free ends and the rams of the additional hydraulic cylinders are rollers mounted on the free piston rod ends for rotation about horizontal axes extending transversely to the rail. In this way, the entire centering mechanism with the rail section end may be spaced from the ties during vertical centering.

Preferably, each roller is journalled for rotation in a bearing affixed to the free piston rod end, and a vertical guide rib defining a guide plane extends transversely to the rail for vertically displaceably guiding the bearing. This assures a torsion-free vertical adjustment of the roller so that the same will always roll in the direction of the rail.

Furthermore, one of the hydraulic cylinders of the rail centering mechanism may extend parallel to the vertical pivoting axes of the clamping members in the plane of symmetry and the ram of this hydraulic cylinder is adapted to be pressed against the rail head. This simple structure enables the rail section end to be bent down in the vertical plane of symmetry towards the ties.

According to another preferred feature, each rail centering mechanism further comprises a carrier plate connected to the transverse beam above the pair of clamping members, the carrier plates of the rail centering mechanisms projecting towards each other and comprising stiffening ribs extending parallel to the rail, the hydraulic cylinders are mounted on the carrier plates and each rail centering mechanism comprises two hydraulic cylinders extending horizontally and perpendicularly to the rail at opposite sides of the plane of symmetry, two additional hydraulic cylinders extending parallel to the vertical pivoting axes of the clamping members, and a further hydraulic cylinder extending parallel to the vertical pivoting axes of the clamping members in a vertical plane of symmetry extending through the rail, and the ram of the further hydraulic cylinder being adapted to be pressed against the rail head. This arrangement, on the one hand, enables the centering mechanism to be simply and stably affixed to the rail tensioning apparatus and, on the other hand, enables the hydraulic cylinders to be simply mounted without in any way interfering with the operation of the closely adjacent pivotal clamping members. It also eliminates the need for a rigid frame interconnecting the centering mechanisms for the two adjacent rail section ends, which is advantageous because such a rigid frame makes it more difficult to position a welding head properly.

The apparatus may further comprise a U-shaped support member affixed to each transverse beam at a side of the beam opposite to the rail centering mechanism in the direction of the rail, the support member being shaped to engage the rail head. In this way, the positioning of the entire rail tensioning apparatus on the adjacent rail section ends automatically centers the apparatus not only with respect to the vertical plane of symmetry but also relative to the height of the rail. When the rail profile changes, the support member may be replaced to conform in shape to the changed profile and thus to assure the desired automatic centering of the apparatus.

The apparatus may further comprise stops affixed to an underside of the transverse beam for limiting the pivoting movement of the clamping members. Such stops will assure a symmetrical pivoting of the two transversely opposite clamping members away from the rail section ends upon actuation of the hydraulic drives connected thereto so that the apparatus may be readily lifted off the rail section ends.

According to another preferred feature, the apparatus further comprises positioning drives interconnecting the longitudinally spaced transverse beams, the positioning drives extending parallel to the hydraulic drives and adjacent thereto. Such positioning drives enable the distance between the two transverse beams to be varied so that the pairs of clamping members are pivoted out of engagement with the rail section ends without operation of the heavy hydraulic drives. At the same time, such positioning drives assure a fixed distance between the transverse beams when the hydraulic drives are used to disengage the clamping members from the rail section ends.

Preferably, two hydraulic drives interconnect the clamping members at each side of the rail sections of the rail, the hydraulic drives extending parallel to each other and to the rail in a common plane extending perpendicularly to the pivoting axes of the clamping members and to the web of the rail sections, the clamping jaws being symmetrically arranged in the common plane with respect to the web. The use of four hydraulic drives arranged in this manner advantageously places them in a common horizontal plane passing through the middle of the rail web and avoids the creation of torsion forces occurring with offset clamping members. At the same time, by using two hydraulic drives at each side, the cylinder diameter of each drive may be reduced, i.e. lighter drives may be used, without reducing the tensile force.

According to another embodiment of this invention, each clamping member has two of said clamping jaws, or two bearings for selectively mounting a respective clamping jaw, longitudinally spaced from each other at respective sides of the pivoting axis. Such a double arrangement of clamping jaws on each clamping member enable the apparatus to be used selectively, upon suitable operation of the hydraulic drives, to exert tensile forces for reducing the gap between the adjacent rail section ends or to apply pressure forces to the adjacent rail section ends to widen the gap. In this manner, when high summer temperatures cause the rail sections to expand and the gap becomes too small for effective flash butt-welding, pressure forces may be applied to move the rail section ends apart so that the rail section ends may be flash-butt welded in the summer, too.

BRIEF DESCRIPTION OF THE DRAWING

The above and other objects, advantages and features of the invention will now be described in detail in connection with certain now preferred embodiments thereof, taken in conjunction with the accompanying drawing wherein.

DETAILED DESCRIPTION OF PREFERRED EMBODIMENTS

Figure 1:
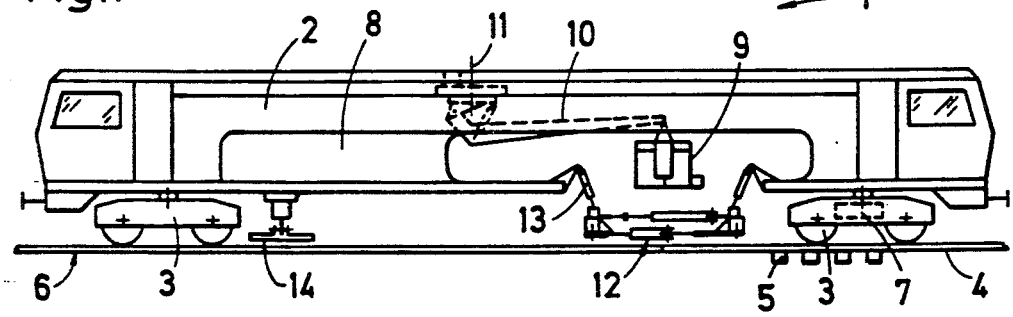
FIG. 1 is a schematic side elevational view of a mobile rail welding machine incorporating a flash butt-welding head and a rail tensioning apparatus according to the present invention.

Referring now to the drawing and first to FIG. 1, there is shown mobile rail welding machine 1 which comprises a bridge-like machine frame 2 having a recessed frame portion between the opposite ends thereof, which are supported by undercarriages 3, 3 for movement along track 6 consisting of two rails 4 fastened to a succession of ties 5 by suitable fastening elements. The machine is driven along the track by drive 7 and carries central power plant 8 including a drive motor, hydraulic pumps and a generator for supplying power to the operating drives of the machine. Electric flash butt-welding head 9 is mounted in the recessed machine frame portion between the machine frame ends and is suspended from telescopingly extendable and vertically adjustable boom 10 which is affixed to machine frame 2 by vertically extending pivot 11 enabling the boom and the welding head to be pivotally adjusted for a welding operation on either rail 4. Rail tensioning apparatus 12 is mounted on machine frame 2 by vertical adjustment drives 13 below welding head 9. Two lifting jacks 13 spaced from each other transversely to track 6 are affixed to machine frame 2 adjacent undercarriage 3 opposite the undercarriage next to welding head 9 and rail tensioning apparatus 12, these lifting jacks being capable of engaging a tie for support thereon and raising machine frame 2 so that the adjacent undercarriage 3 will be lifted off track 6.

Figure 2:
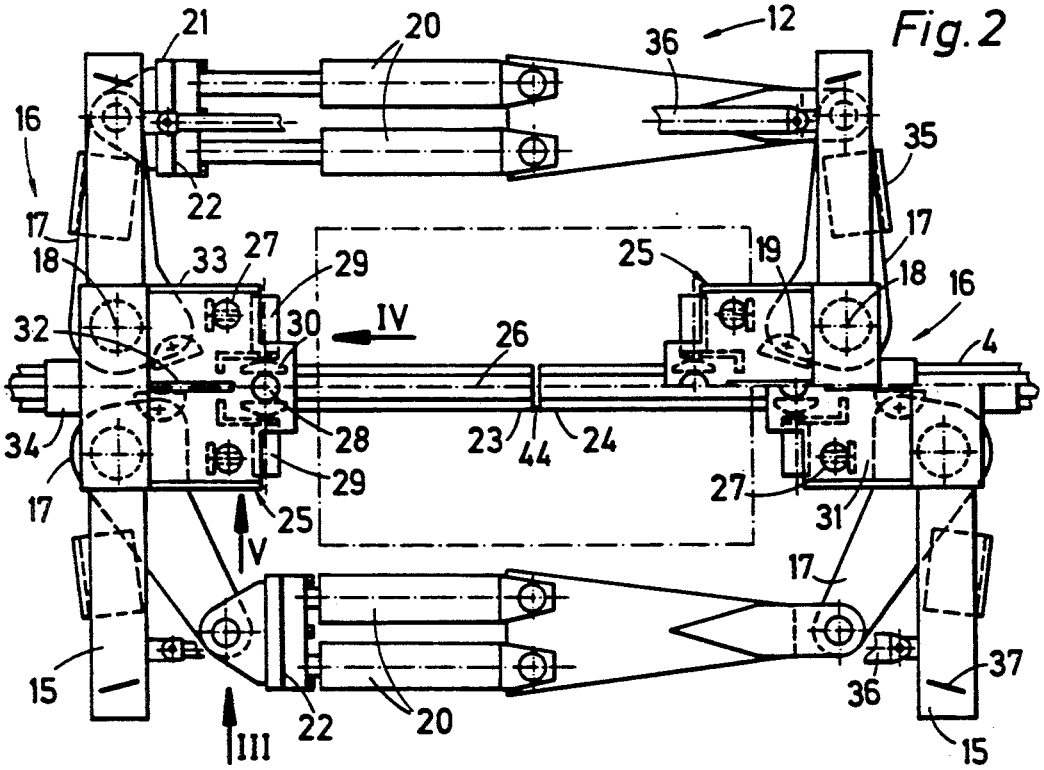
FIG. 2 shows an enlarged top view of the rail tensioning apparatus.
Figure 3:
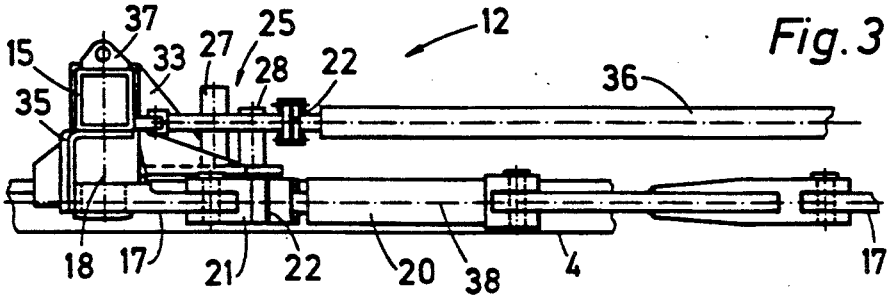
FIG. 3 is a fragmentary side elevational view seen in the direction of arrow III of FIG. 2.
Figure 4:
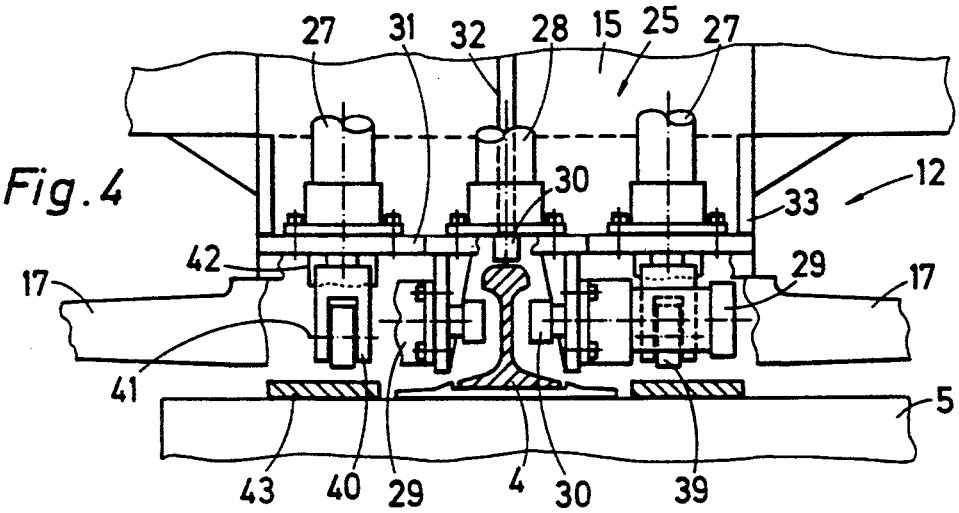
FIG. 4 is an enlarged fragmentary end view seen in the direction of arrow IV of FIG. 2 and showing the rail centering mechanism of the apparatus.

FIGS. 2 to 5 illustrate an embodiment of an apparatus 12 for changing the width of gap 44 between an end 23 of a rail section and an adjacent end 24 of a longitudinally succeeding rail section of rail 4 fastened to ties 5 by fastening elements. The two rails 4 and ties 5 constitute components of track 6 and, as best shown in FIG. 4, each rail section comprises a vertically extending web and a rail head. Gap 44 may be reduced by tensioning or longitudinally extending the rail section after the fastening elements fastening the rail section to the ties have been loosened. Apparatus 12 comprises two longitudinally spaced beams 15, 15 extending transversely to track rails 4, and a pair of clamping members 17 mounted on each transverse beam 15 for pivoting about parallel vertical axes 18 at respective sides of the rail sections of rail 4 and having cooperating clamping jaws 19 for engaging the rail sections between clamping members 17 upon pivoting thereof. As shown in FIG. 2, pairs 16 of clamping members 17 are longitudinally spaced from each other, and hydraulic drives 20 interconnect the clamping members at each side of the rail sections of the rail. In FIG. 2, clamping members 17 on one side of rail 4, i.e. above the rail, are shown pivoted out of clamping engagement with rail section end 23 while the clamping members on the opposite side of this rail section end are shown clamped into engagement with the rail section end. In the illustrated embodiment, two hydraulic drives 20, 20 interconnect clamping members 17 at each side of the rail sections of rail 4, the hydraulic drives extending parallel to each other and to the rail in common plane 38 extending perpendicularly to pivoting axes 18 of clamping members 17 and to the web of the rail sections, and the clamping jaws are symmetrically arranged in the common plane with respect to the web, the common plane passing substantially through the center of the web, as shown in FIG. 4. Hydraulic drives 20 are pivotally linked to ends of clamping members 17 opposite the clamping member ends about which the clamping members are pivoted at 18. The piston rods of the two hydraulic drives 20 at each side of rail 4 are affixed to a common yoke facing an end flange of link 21 pivoted to clamping members 17, and electrical insulation layer 22 is positioned between the common yoke and the end flange to insulate the drives from the clamping members. This securely prevents any possible short circuit between the rail section ends 23, 24 during the electric flash butt-welding operation.

According to the invention, apparatus 12 further comprises rail centering mechanism 25 affixed to each transverse beam 15 in the range of each pair 16 of clamping members 17. Each rail centering mechanism comprises at least two independently operable hydraulic cylinders 27, 28, 29 carrying rams 30 adapted to be pressed against at least one of the track components of rail 4, i.e. the rail sections and/or the ties, upon operation of the hydraulic cylinders.

As shown in the drawing, hydraulic drives 20 extend substantially parallel to rail 4 and vertical plane of symmetry 26 extends through the rail between the sides thereof (see FIG. 2). In the illustrated embodiment, rail centering mechanism 25 comprises two hydraulic cylinders 29 extending horizontally and perpendicularly to rail 4 at opposite sides of the plane of symmetry, two additional hydraulic cylinders 27 extending parallel to vertical pivoting axes 18 of clamping members 17, one hydraulic cylinder 28 extends parallel to the vertical pivoting axes of the clamping members in the plane of symmetry 26 and ram 30 of the one hydraulic cylinder 28 is adapted to be pressed against the rail head.

Figure 5:
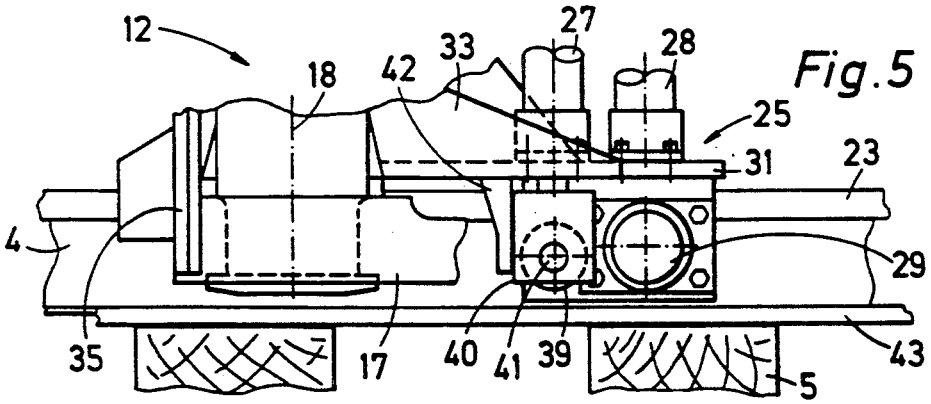
FIG. 5 shows an enlarged fragmentary side view seen in the direction of arrow V if FIG. 2 and showing the rail centering mechanism.

As best shown in FIG. 4, additional hydraulic cylinders 27 have downwardly projecting vertical piston rods having free ends and the rams of the additional hydraulic cylinders are rollers 39 mounted on the free piston rod ends for rotation about horizontal axes 41 extending transversely to the rail. Each roller 39 is journalled for rotation in bearing 40 affixed to the free piston rod end, and vertical guide rib 42 projecting from the underside of carrier plate 31 defines a guide plane extending transversely to the rail for vertically displaceably guiding bearing 40 of roller 39. FIGS. 4 and 5 illustrate the gliding guidance of bearing 40 and roller 39 along the guide plane defined by rib 42 so that the roller may be lowered into engagement with a support plate 43 (not shown in FIGS. 2 and 3) which is placed over a few successive ties 5. If desired, the rams on hydraulic cylinders 27 may be pressure pads instead of rollers for skidding engagement with support plates 43 laid on each side of rail 4. Each transversely extending hydraulic cylinder 29 is bolted to a flange projecting from the underside of carrier plate 31 at each side of rail 4. The mounting flanges for hydraulic cylinders 29 have central apertures permitting clamping jaws 30 to pass freely therethrough into engagement with the rail web upon actuation of cylinders 29.

In the illustrated preferred embodiment, each rail centering mechanism 25 further comprises carrier plate 31 connected to transverse beam 15 above the pair 16 of clamping members 17. The carrier plates 31 of rail centering mechanisms 25 project towards each other (see FIG. 2) and comprise stiffening ribs 32, 33 extending parallel to rail 4, and hydraulic cylinders 27, 28, 29 are mounted on carrier plates 31.

This preferred embodiment of apparatus 12 further comprises U-shaped support member 34 affixed to each transverse beam 15 at a side of the beam opposite to rail centering mechanism 25 in the direction of the rail, the support member being shaped to engage the rail head. Stops 35 are affixed to an underside of transverse beam 15 (see FIG. 3) for limiting the pivoting movement of clamping members 17. Apparatus 12 further comprises positioning drives 36 interconnecting the longitudinally spaced transverse beams 15, 15, the positioning drives extending parallel to hydraulic drives 20 and adjacent thereto. Similarly to hydraulic drives 20, positioning drives 36 are electrically insulated by interposition of electrical insulation layers 22 (see FIG. 3).

As best shown in FIG. 2, hydraulic drives 20 and transverse beams 15 constitute a ring-shaped mechanical unit defining a sufficiently large central space to accommodate flash butt-welding head 9 (shown in phantom lines) lowered into an operating position for welding rail section ends 23, 24 together while apparatus 12 holds gap 44 at the desired width. Vertical adjustment drives 13 are attached to lugs 37 on transverse beams 15, 15 for vertically adjusting apparatus 12 but these adjustment drives have been shown only in FIG. 1.

Figure 6:
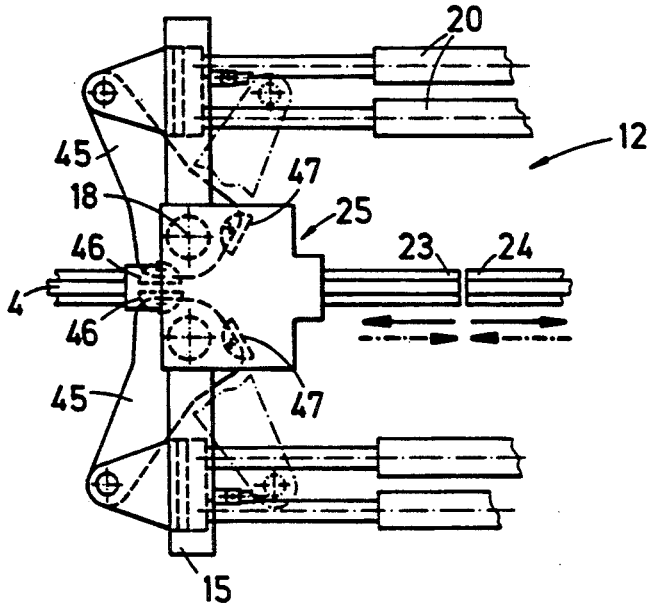
FIG. 6 is a fragmentary top view showing another embodiment of the clamping jaw arrangement for selectively transmitting tensile or pressure forces to the rail section ends.

In the embodiment of apparatus 12 shown in FIG. 6, like reference numerals designate like parts operating in a like manner as in the embodiment described hereinabove in connection with FIGS. 1 to 5. This embodiment differs from the first-described embodiment by mounting two clamping jaws 46, 47 on each clamping member 45, the two clamping jaws being longitudinally spaced from each other at respective sides of pivoting axis 18. With this arrangement, rail sections ends 23, 24 may be selectively subjected to tensile forces (shown in phantom lines) to extend or tension the rail sections or to pushing forces (shown in full lines) to retract the rail section ends. The transmission of a thrust to the rail section end, instead of a tension, may be effected simply by pivoting clamping members 45 from their phantom-line position into the full-line position so that trailing clamping jaws 46 engage the rail section end, instead of leading clamping jaws 47. This arrangement makes it possible to weld rail section ends together in summer temperatures.

If desired, each clamping member 45 may merely have two bearings for selectively mounting a respective clamping jaw 46, 47 on the clamping member so that either one of the clamping jaws may be mounted in the bearing, depending on the desired use.

Welding machine 1 operates in the following manner:

After the machine has been advanced to the operating site and welding head 9 and apparatus 12 have been centered over rail section ends 23, 24, hydraulically operated vertical adjustment drives 13 are operated to lower apparatus 12 until support members 34 of transverse beams 15 engage the heads of the rail sections. At this time, all four clamping members 17 rest against stops 35 in their disengaged position (shown in the top half of FIG. 2). Now, support plates 43 are placed over a succession of ties 5 (see FIG. 5) in alignment with support rollers 39 and transverse beams 15, 15 are spaced from each other by operation of positioning drives 36. This repositioning of the transverse beams (see lower half of FIG. 2) causes clamping members 17 to be pivoted into engagement with the webs of the rail sections. At this point, lifting jacks 14 are lowered into engagement with ties 5 underlying the jacks, and the jacks are operated to lift adjacent undercarriage 3 slightly off track 6 so that the rail section, which subsequently is to be tensioned or retracted, is no longer subjected to the load of machine frame 2. For a distance of about 100 m, the elements fastening this rail section to the ties are then loosened and the four hydraulic drives 20 are operated simultaneously to vary gap 44 between rail section ends 23 and 24. In the embodiment of FIGS. 1 to 5, this means reducing the gap by pulling rail section end 23 closer to rail section end 24. This tensioning of the one rail section is continued until the desired gap width for flash butt-welding of the two rail section ends has been obtained. While the rail section ends are thus held under tension, they are centered relative to each other by operation of centering mechanism 25. Depending on the relative positions of the rail section ends, hydraulic cylinders 27, 28 and 29 are selectively operated until rail section ends 23, 24 are longitudinally aligned. A desired upward bending of the rail section ends is then obtained by pressing rollers 39 against support plates 43 by operation of cylinders 27. At the same time, selective operation of one or the other cylinder 29 will transversely align the rail section ends. If one of the rail section ends is higher than the other, it is depressed by operation of cylinder 28.

After the adjacent rail section ends have thus been suitably spaced and correctly centered, boom 10 is operated to position and lower welding head 9 in the free center space of apparatus 12, as shown in phantom lines in FIG. 2, while hydraulic drives 20 remain in operation. The necessary compression or upset impact required for completing the flash butt-welding of rail section ends 23, 24 to each other while they are heated to their melting temperature and are pressed together under very high pressure is obtained by the high tensile forces exerted by hydraulic drives 20 and synchronously operating longitudinal displacement drives incorporated in welding head 9. The simultaneous operation of flash butt-welding head 9 and surrounding rail tensioning apparatus 12 enables rail section ends to be securely welded together even if gap 44 is relatively wide and the rail sections are very heavy. Hydraulic drives 20 remain in operation even after the welding operation has been completed until the welded joint has cooled and is capable of absorbing high tensile forces.

What is claimed is:

1. An apparatus for changing the width of a gap between an end of a rail section and an adjacent end of a longitudinally succeeding rail section of a rail fastened to ties by fastening elements, two of said rails and the ties constituting components of a track and each rail section comprising a vertically extending web and a rail head, the gap being reduced by tensioning or longitudinally extending the rail section after the fastening elements fastening the rail section to the ties have been loosened, the apparatus comprising (a) two longitudinally spaced beams extending transversely to the track rails, (b) a pair of clamping members mounted on each transverse beam for pivoting about parallel vertical axes at respective sides of the rail sections of the rail and having cooperating clamping jaws for engaging the rail sections between the clamping members upon pivoting thereof, the pairs of clamping members being longitudinally spaced from each other, (c) hydraulic drives interconnecting the clamping members at each side of the rail sections of the rail, and (d) a rail centering mechanism affixed to each transverse beam in the range of each pair of clamping members, each rail centering mechanism comprising (1) at least two independently operable hydraulic cylinders carrying rams adapted to be pressed against at least one of said track components of the rail upon operation of the hydraulic cylinders.

2. The apparatus of claim 1, wherein the hydraulic drives extend substantially parallel to the rail and a vertical plane of symmetry extends through the rail between the sides thereof, and the rail centering mechanism comprises two of said hydraulic cylinders extending horizontally and perpendicularly to the rail at opposite sides of the plane of symmetry, and two additional ones of said hydraulic cylinders extending parallel to the vertical pivoting axes of the clamping members.

3. The apparatus of claim 2, wherein the additional hydraulic cylinders have downwardly projecting vertical piston rods having free ends and the rams of the additional hydraulic cylinders are rollers mounted on the free piston rod ends for rotation about horizontal axes extending transversely to the rail.

4. The apparatus of claim 3, further comprising a bearing wherein each of the rollers is journalled for rotation, the bearing being affixed to the free piston rod end, and a vertical guide rib defining a guide plane extending transversely to the rail for vertically displaceably guiding the bearing.

5. The apparatus of claim 1, wherein the hydraulic drives extend substantially parallel to the rail and a vertical plane of symmetry extends through the rail between the sides thereof, and one of said hydraulic cylinders of the rail centering mechanism extends parallel to the vertical pivoting axes of the clamping members in the plane of symmetry and the ram of the one hydraulic cylinder is adapted to be pressed against the rail head.

6. The apparatus of claim 1, wherein each rail centering mechanism further comprises a carrier plate connected to the transverse beam above the pair of clamping members, the carrier plates of the rail centering mechanisms projecting towards each other and comprising stiffening ribs extending parallel to the rail, the hydraulic cylinders are mounted on the carrier plates and each rail centering mechanism comprises two of said hydraulic cylinders extending horizontally and perpendicularly to the rail at opposite sides of the plane of symmetry, two additional ones of said hydraulic cylinders extending parallel to the vertical pivoting axes of the clamping members, and a further one of said hydraulic cylinders extending parallel to the vertical pivoting axes of the clamping members in a vertical plane of symmetry extending through the rail, and the ram of the further one hydraulic cylinder being adapted to be pressed against the rail head.

7. The apparatus of claim 1, further comprising a U-shaped support member affixed to each transverse beam at a side of the beam opposite to the rail centering mechanism in the direction of the rail, the support member being shaped to engage the rail head.

8. The apparatus of claim 1, further comprising stops affixed to an underside of the transverse beam for limiting the pivoting movement of the clamping members.

9. The apparatus of claim 1, further comprising positioning drives interconnecting the longitudinally spaced transverse beams, the positioning drives extending parallel to the hydraulic drives and adjacent thereto.

10. The apparatus of claim 1, wherein two of said hydraulic drives interconnect the clamping members at each side of the rail sections of the rail, the hydraulic drives extending parallel to each other and to the rail in a common plane extending perpendicularly to the pivoting axes of the clamping members and to the web of the rail sections, the clamping jaws being symmetrically arranged in the common plane with respect to the web.

11. The apparatus of claim 1, wherein each clamping member has two of said clamping jaws longitudinally spaced from each other at respective sides of the pivoting axis.

12. The apparatus of claim 1, wherein each clamping member has two bearings for selectively mounting a respective one of the clamping jaws, the bearing being longitudinally spaced from each other at respective sides of the pivoting axis.

* * * * *